United States Patent [19]

Dillingham

[11] Patent Number: 4,632,285

[45] Date of Patent: Dec. 30, 1986

[54] CONVERTIBLE NECKTIE AND BELT HANGER APPARATUS

[76] Inventor: Richard F. Dillingham, 4309 Shady Hill, Dallas, Tex. 75229

[21] Appl. No.: 704,638

[22] Filed: Feb. 22, 1985

[51] Int. Cl.[4] ..... A47G 25/74

[52] U.S. Cl. ..... 223/88; 223/DIG. 1

[58] Field of Search ..... 223/DIG. 1, 88, 87, 223/85, 81, 82; 211/113, 119, 124; D6/315-328

[56] References Cited

U.S. PATENT DOCUMENTS

| | | | |
|---|---|---|---|
| D. 156,600 | 12/1949 | Brown | D6/323 |
| D. 277,248 | 1/1985 | Benedict | D6/324 |
| 1,815,673 | 7/1931 | Kelley | 211/119 |
| 1,996,552 | 4/1935 | Schwender | 211/113 |
| 2,025,114 | 12/1935 | Legus | 223/88 |
| 2,284,552 | 5/1942 | Arenz | D6/320 |
| 2,455,478 | 12/1948 | Grant | 223/88 |
| 2,496,473 | 2/1950 | Hunt et al. | 223/88 |
| 2,634,031 | 4/1953 | Klein | 223/88 |
| 2,848,114 | 8/1958 | Kruger | 223/113 |
| 2,915,232 | 12/1959 | Deucher | 223/88 |
| 2,929,509 | 3/1960 | Van Dusen | 211/119 |
| 3,133,643 | 5/1964 | Lester | 211/116 |
| 3,203,556 | 8/1965 | Tejerian | 211/119 |
| 3,370,715 | 2/1968 | Kolozsvari | 211/119 |
| 3,592,343 | 7/1971 | Swett | 223/88 |
| 4,059,191 | 10/1977 | Chaisson | 223/DIG. 1 |
| 4,428,486 | 1/1984 | Collins | 211/119 |

*Primary Examiner*—Louis K. Rimrodt
*Assistant Examiner*—Joseph S. Machuga
*Attorney, Agent, or Firm*—Hubbard, Thurman, Turner & Tucker

[57] ABSTRACT

A convertible necktie and belt hanger apparatus includes an elongated generally planar support member from which spaced apart formed wire necktie hanger members and a belt hook support member depend in a generally co-planar relationship. The belt hook support member is disposed between opposed ones of the necktie hanger members and is adapted to support a plurality of open throat hooks for hanging belts or other articles of apparel thereon. The apparatus includes a hook which may be removably connected to the support member at a top side thereof for hanging the apparatus from a clothing support rod or the like. Alternatively, a mounting bracket is provided for supporting the apparatus against a vertical wall surface.

7 Claims, 4 Drawing Figures

CONVERTIBLE NECKTIE AND BELT HANGER APPARATUS

BACKGROUND OF THE INVENTION

1. Field of the Invention

The present invention pertains to a combination necktie and belt or related apparel article hanger apparatus which may be hung from a detachable hook or mounted on a vertical wall using a cooperating bracket member.

2. Background

In the art of necktie and belt hangers, there have been several devices developed which are adapted to support a plurality of neckties and or belts or similar articles of apparel and be hung from a closet clothes rod or similar hook supporting structure. One type of device known comprises a formed wire necktie hanger having spaced apart vertically extending hanger bars which provide a recess for receiving a plurality of neckties in vertical stacked relationship. The hanger apparatus has a conventional coat hanger type hook member for hanging the apparatus itself from a closet clothes rod or other supporting structure. U.S. Pat. Nos. Des. 175,880; 206,638; U.S. Pat. Nos. 2,777,582 and 3,342,345 disclose apparatus of this general type. Another type of necktie hanger is characterized by a support member having a conventional hook projecting therefrom, a necktie hanger and a belt hanger member disposed back to back.

Both of the aforementioned types of devices are generally suitable for hanging the apparatus itself from a clothes rod or other hook supporting structure where there is sufficient room in a closet or the like to suspend the apparatus. In the latter mentioned device it is not unusual that, according to the way in which it is hung in a closet, either the necktie hanger or the belt hanger member is generally inaccessible since it usually faces away from a person searching for an article hung on the hanger apparatus. However, several deficiencies in prior art necktie hanger apparatus and similar devices have been overcome with the present invention.

SUMMARY OF THE INVENTION

The present invention provides a combination necktie and belt or similar article hanger apparatus wherein a necktie member and a belt hanger member are arranged generally side by side and secured to a support member and may be adapted to be used in conjunction with a detachable hook for hanging the apparatus from a clothes rod or similar hook receiving structure or the apparatus may be mounted generally flush against a vertical wall or the like.

In accordance with one aspect of the present invention there is provided a combination necktie and belt hanger apparatus having a support member and a pair of spaced apart necktie hanger members connected to and depending from the support member and each being adapted to receive a plurality of neckties in stacked relationship and wherein any one of the ties may be easily removed from the hanger member without disturbing the remaining ties. In accordance with another aspect of the invention, the apparatus includes hanger means for hanging a plurality of belts or other articles of apparel and wherein the hanger means is arranged in a generaly co-planar relationship depending from the support member and between the opposed necktie hanger members so that the support member may be suspended from a removable hook or the apparatus may be secured to a vertical wall surface or the like using a demountable support bracket.

In accordance with yet another aspect of the present invention, the necktie and belt hanger apparatus includes a pair of spaced apart necktie hanger members having vertically extending hanger bars spaced apart from each other a width slightly less than the nominal minimum width of a conventional necktie so that when the ties are hung on the tie hanger members there is a slight cant or slope to the tie whereby it can be more easily removed from the hanger member. The general arrangement of the necktie hanger member and a belt hanger means is such that the necktie hanger member and the belt hanger are arranged generally side by side and co-planar so that the support member may be mounted on a vertical planar wall surface. The belt hanger member preferably includes a plurality of hooks which depend from a support bar and have a throat portion opening in the same general direction as the receptacle part for the necktie hanger.

In accordance with still a further aspect of the present invention a convertible necktie and belt hanger apparatus is provided with spaced apart necktie hanger members arranged in such a way that a support member for both a belt hanger member and the necktie hanger members can be operably supported on a wall or the like by a removable mounting bracket which is cooperable with the belt hanger member. A plurality of belt hooks are disposed side by side loosely on the belt hanger member.

The abovenoted features and advantages of the present invention as well as other superior aspects thereof will be further appreciated by those skilled in the art upon reading the following description in conjunction with the drawing.

BRIEF DESCRIPTION OF THE DRAWING

FIG. 1 is a perspective view of the convertible necktie and belt hanger apparatus utilizing a support hook for hanging the apparatus from a closet clothes rod or the like;

DESCRIPTION OF THE PREFERRED EMBODIMENT

Figure 1:
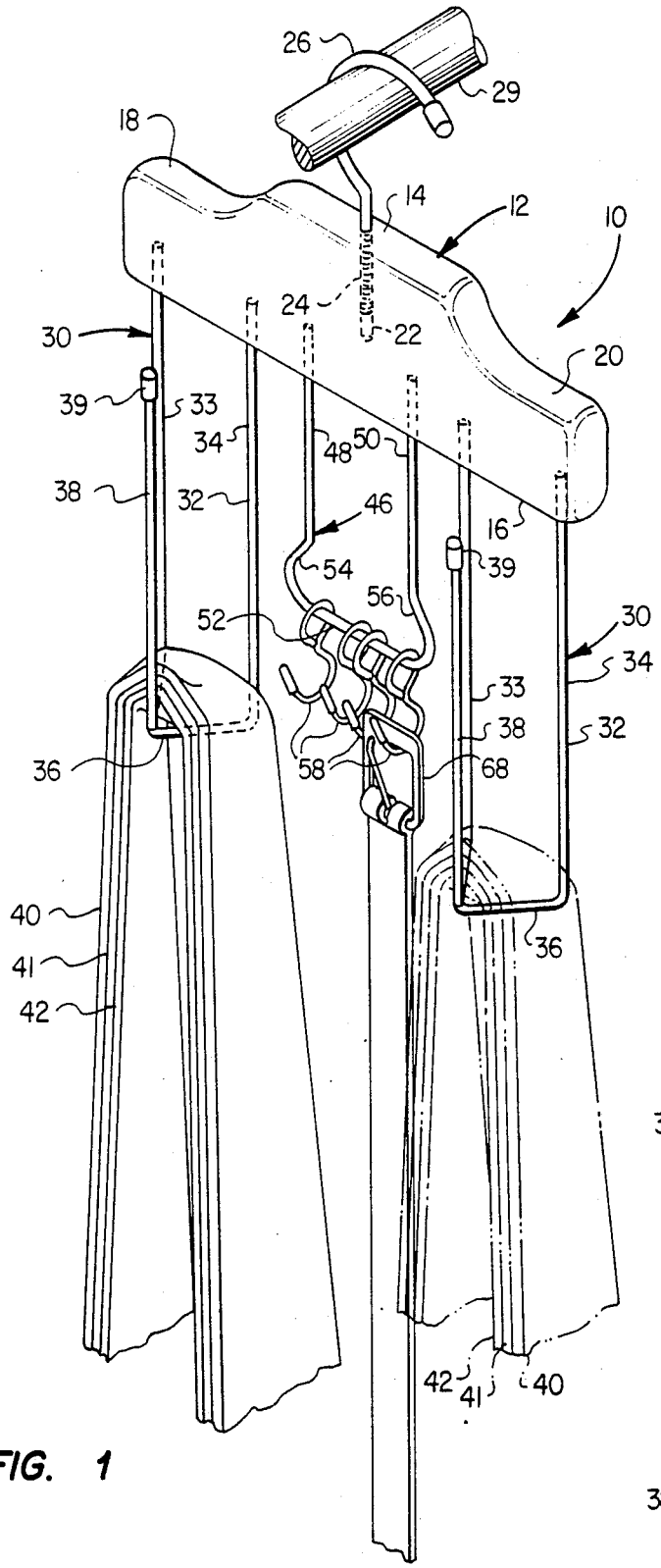

Referring to FIG. 1, there is illustrated an improved convertible necktie and belt hanger apparatus in accordance with the present invention and generally designated by the numeral 10. The apparatus 10 includes an elongated generally planar support member 12 which may be formed of decorative wood, metal or plastic. The support member 12 includes a top side edge 14 and a bottom side edge 16, which are generally parallel and a pair of opposed shoulder portions 18 and 20. A threaded hole 22 is provided in the top side edge 14 for receiving a cooperating threaded shank 24 of a support hook 26. The support hook 26 may be conveniently threadedly engaged with or removed from the support member 12. The hook 26 is adapted to suspend the apparatus 10 from a conventional closet clothing support rod or the like 29.

The apparatus 10 includes a pair of spaced apart necktie hanger members each generally designated by the numeral 30. The hanger members 30 are preferably characterized by a somewhat U-shaped formed wire hanger bar 32 formed by a pair of opposed legs 33 and 34 which are secured to the support member 12 and depend therefrom from the bottom side edge 16. The hanger bar 32 includes a bottom connecting web portion 36, and a third vertically extending hanger bar 38 is spaced from the legs 33 and 34 and forms a recess between the bars 32 and 38 for the receipt of a plurality of conventional four-in-hand neckties or the like 40, 41, 42. The legs 33 and 34 may be suitably secured to the support member 12 by extension into drilled holes in the respective shoulders 18 and 20, which open to the bottom side edge 16. Such holes may be of a diameter such that the generally cylindrical wire or rod legs 33 and 34 are press fitted into the holes to secure the hanger members 30 to the support member 12.

In accordance with one advantageous aspect of the hanger members 30 the minimum distance between the hanger bar 38 and a plane which includes the hanger bar legs 33 and 34 is slightly less than the minimum width of the neckties 40, 41 and 42. Accordingly, when the neckties are inserted in the recess or receptacle formed between the hanger bars 32 and 38, each tie will characteristically tend to lay at a slight cant or angle. This position of each of the neckties facilitates removing a tie which is located below the topmost necktie whereby the necktie to be removed may be grasped at a point generally adjacent the bar 38 and with a twisting and rapid vertical upward pulling or flipping motion the tie which is desired to be removed from the hanger member may be easily snapped or slipped out of the stack.

The apparatus 10 also includes hanger means for belts and other articles of apparel comprising a formed wire hanger member, generally designated by the numeral 46, and characterized by a pair of spaced apart legs 48 and 50 which are integrally formed with a connecting, generally horizontally extending rod section 52. The hanger member 46 includes reversely bent portions 54 and 56 interconnecting the legs 48 and 50 with the horizontal rod section 52. The reverse bend portions 54 and 56 provide for maximizing the length of the hanger rod section 52 while providing relatively close spacing between the legs 48 and 50 for a purpose to be explained herein.

Figure 3:
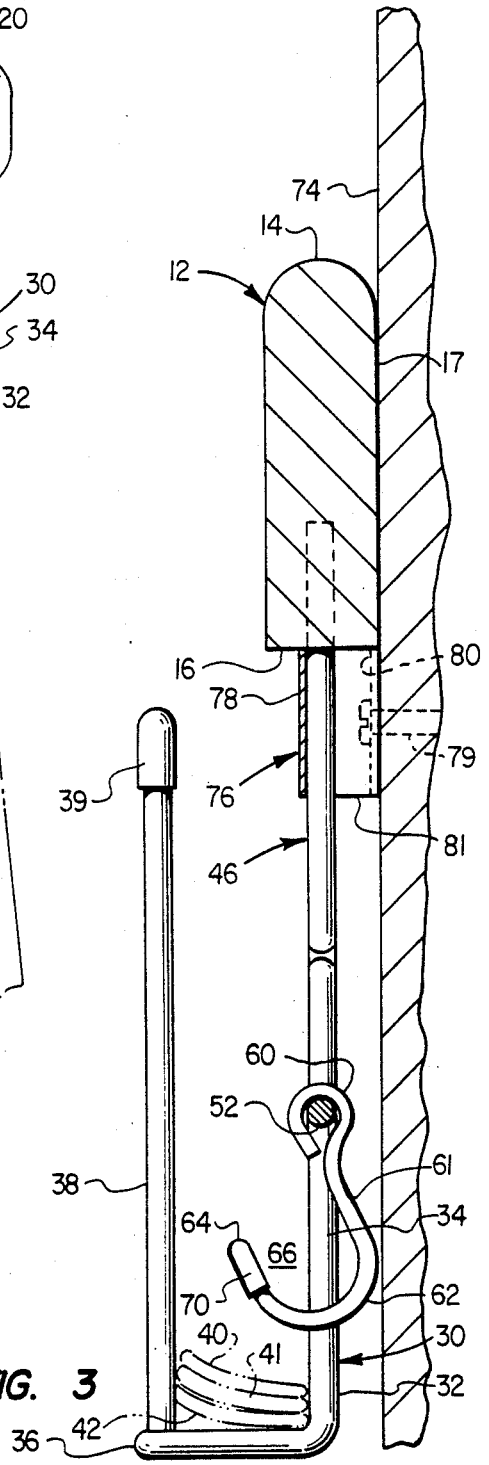
FIG. 3 is a section view taken generally along the line 3—3 of FIG. 2.

Referring also to FIG. 3, the belt hanger member 46 is adapted to support a plurality of free swinging depending hooks 58 which are supported side by side on the horizontal rod section 52. The hooks 58 are preferably characterized as formed wire members having a generally closed loop support eye portion 60, a depending shank 61, a curved body portion 62 and a tip 64 defining a throat 66 for receiving a belt buckle 68 or the like as shown in FIG. 1. The tip 64 may be provided with a protective cover or cap 70 formed of a suitable resilient plastic or elastomeric material. The formed wire hanger members 30 and 46 are arranged generally co-planar with each other as illustrated in FIG. 3 and the hanger legs 48 and 50 are also force fitted into suitable receiving holes drilled or otherwise formed in the bottom edge 16 of the support member 12.

The configuration of the hooks 58 is such that the throats 66 of the hooks open in the same direction as the receptacles formed by the hanger members 30 and the belt hanger member 46 is desirably disposed between spaced apart ones of the necktie hanger members 30 so that a generally balanced arrangement of the tie and belt hanger portions of the apparatus is provided. In this way, when the apparatus 10 is utilized in conjunction with the support hook 26 the support member 12 will tend to hang in a generally balanced nontilting position, assuming of course that a roughly equal number of neckties are supported by each of the hanger members 30.

Figure 2:
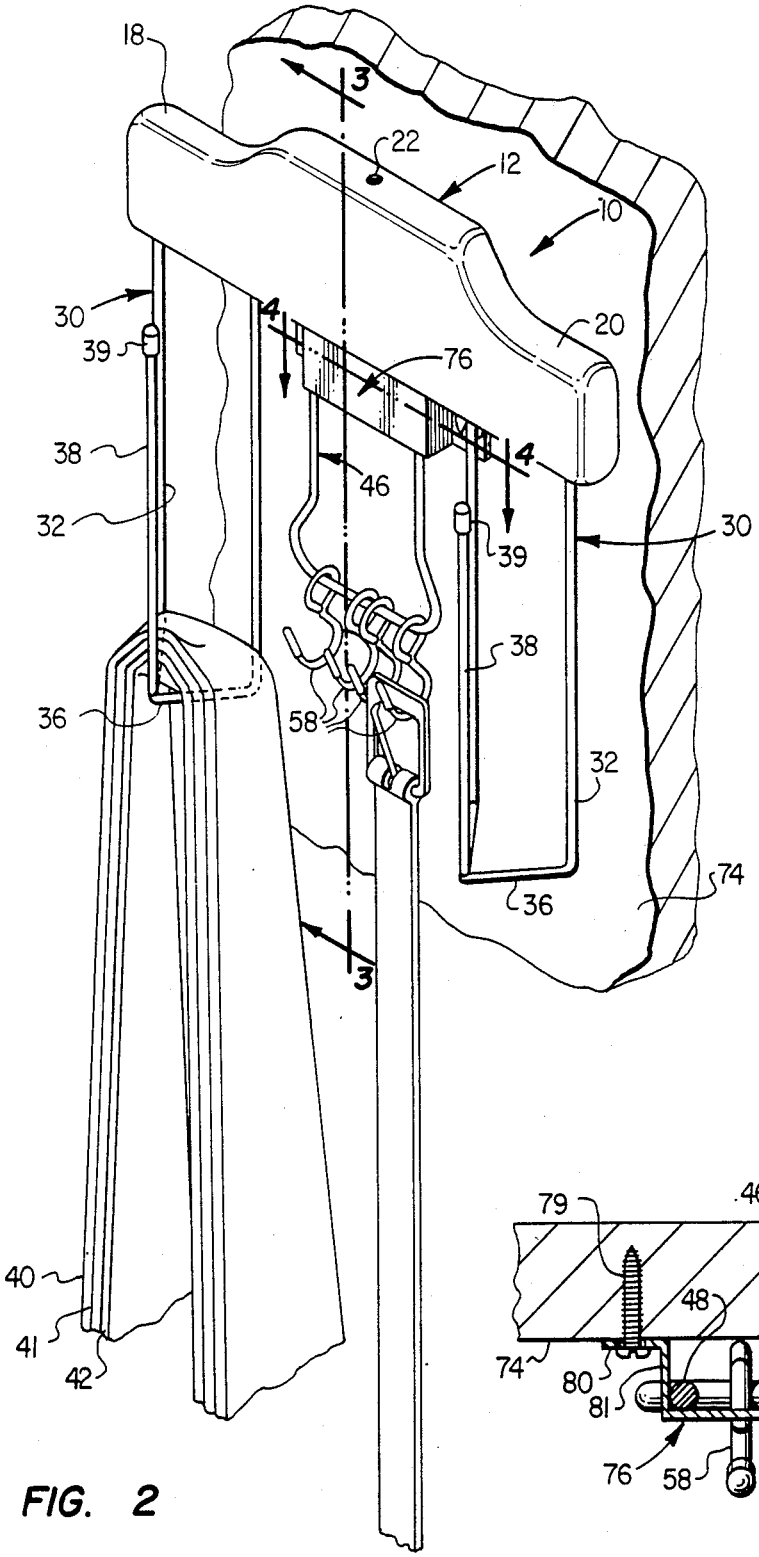
FIG. 2 is a perspective view of the apparatus mounted on a vertical wall surface utilizing a unique mounting bracket.
Figure 4:
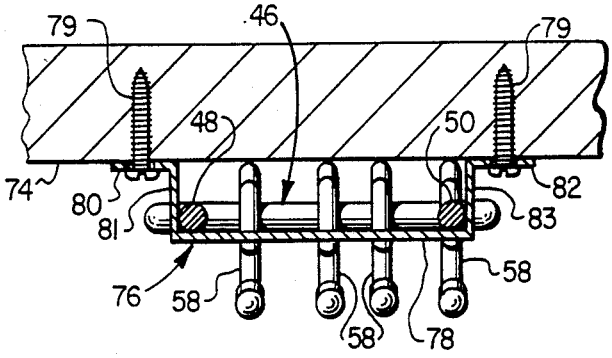
FIG. 4 is a detail section view taken along line 4—4 of FIG. 2.

Referring now primarily to FIGS. 2 through 4, the apparatus 10 is also uniquely adapted to be supported on a generally vertical wall surface 74, for example, by the provision of support means comprising a bracket member 76 which is preferably formed from a piece of decorative metal plate having a generally flat web portion 78 and opposed tab portions 80 and 82, FIG. 4. The tab portions 80 and 82 are interconnected with the web 78 by integral flange portions 81 and 83 which are spaced apart a distance slightly greater than the distance between the legs 48 and 50 of the hanger member 46. As shown in FIG. 3, in particular, the apparatus 10 is conveniently supported against the wall surface 74 wherein the generally planar surface 17 of the support member 12 is contiguous with the wall surface and, by placing the bracket 76 directly beneath the bottom side edge 16 and securing the bracket with suitable fasteners 79, FIGS. 3 and 4, the apparatus 10 is conveniently mounted flush with and parallel to the wall surface.

Moreover, thanks to the configuration of the hanger members 30 and 46 and the hooks 58 the apparatus may be utilized conveniently in either a mounting arrangement as illustrated in FIGS. 2 and 3 or when suspended from the hook 26. Accordingly, a relatively versatile necktie and belt hanger apparatus is provided which does not require as much space as prior art devices which are adapted for hanging both belts and neckties and yet is uniquely adapted to be used in conjunction with a hook and hung from a clothing rod or similar structure in the same manner as a clothes hanger or may be subjected to a somewhat more permanent mounting against a closet wall or the like wherein a minimal amount of space is occupied by the hanger apparatus in either of its positions of use.

The apparatus 10 may be fabricated using conventional engineering materials such as, decorative wood, plastic or metal for the support member 12, as mentioned above. The hanger members 30 may be formed of steel wire which may be coated with a decorative and corrosion resistant coating or the like and wherein the tips of the hanger bars 38 may be covered by a protective cap 39 similar to the cap 70. The hanger member 46 may be formed of the same diameter wire or rod as the hanger members 30 and the hooks 58 may also be formed of steel wire or rod which has been coated with a coating or plating of a color to match or be compatible with the coatings on the members 30 and 46. Although a preferred embodiment of the invention has been described herein, those skilled in the art will recognize that various substitutions and modifications may be made to the specific embodiment disclosed without departing from the scope and spirit of the invention as recited in the appended claims.

What I claim is:

1. A convertible necktie and belt hanger apparatus comprising:

a support member;

necktie hanger means connected to and depending from said support member;

belt hanger means connected to and depending from said support member generally adjacent to said necktie hanger means in such a way that said support member can be supported by hook means for hanging said apparatus, and said apparatus can be supported on a vertical surface by mounting bracket means whereby said necktie hanger means and said belt hanger means are operable when said apparatus is supported by said hook means and said bracket means, respectively;

said necktie hanger means including two necktie hanger members spaced apart from each other and depending from said support member, and said belt hanger means disposed on said support member between said necktie hanger members; and said necktie hanger members each including rearwardly disposed hanger bar means and a front hanger bar extending upward from and spaced from said rear hanger bar means a distance slightly less than the width of neckties.

2. The apparatus set forth in claim 1 wherein:

said belt hanger means includes a formed wire hanger member including opposed legs secured to and depending from said support member and a connecting rod portion between said legs, and at least one belt hook member supported by and depending from said belt hanger member.

3. The apparatus set forth in claim 2 including:

a plurality of belt hook members each having a shank portion and a body portion, said body portion projecting laterally relative to said shank portion when said belt hook member is hanging from said belt hanger member in generally the same direction as said front hanger bar with respect to said rear hanger bar, respectively.

4. The apparatus set forth in claim 3 wherein:

said hook members are supported on said rod portion for movement relative to each other along said rod portion.

5. A convertible necktie and belt hanger apparatus comprising:

a generally planar support member;

first and second necktie hanger members connected to and depending from said support member and spaced apart on said support member;

belt hanger means connected to and depending from said support member and interposed between said necktie hanger members;

hook means adapted to be detachably connected to said support member for hanging said apparatus from a support rod or the like; and mounting bracket means for securing said apparatus to a vertical wall whereby said apparatus can be selectively hung from said hook means and secured to said wall with said bracket means, respectively;

said belt hanger means includes a formed wire hanger member including opposed legs secured to and depending from said support member and a connecting rod portion between said legs, at least one belt hook member supported by and depending from said belt hanger member, and said bracket means includes a bracket plate having opposed tab portions adapted to engage said legs to secure said apparatus to a wall surface.

6. The combination set forth in claim 5 including:

a plurality of belt hook members each having a shank portion and a body portion, said body portion projecting laterally relative to said shank portion when said belt hook member is hanging from said belt hanger member.

7. A necktie and belt hanger apparatus comprising:

an elongated generally planar support member;

necktie hanger means connected to and depending from said support member, said necktie hanger means including a pair of formed wire hanger members each including at least first and second spaced apart hanger bars for receiving therebetween a plurality of neckties hung between said hanger bars in stacked relationship, belt hanger means connected to and depending from said support member and including a plurality of belt hook members each having a body and a tip projecting from said body in the same direction as the spacing between said hanger bars so that said support member can be mounted on a vertical wall with said hook means and said hanger bars oriented to receive and permit removal of neckties and belts or the like with respect to said apparatus.

* * * * *